United States Patent [19]

Baugh

[11] Patent Number: 4,651,831

[45] Date of Patent: Mar. 24, 1987

[54] SUBSEA TUBING HANGER WITH MULTIPLE VERTICAL BORES AND CONCENTRIC SEALS

[76] Inventor: Benton F. Baugh, 14626 Oak Bend, Houston, Tex. 77079

[21] Appl. No.: 742,428

[22] Filed: Jun. 7, 1985

[51] Int. Cl.[4] ..... E21B 33/043

[52] U.S. Cl. ..... 166/344; 166/313; 166/75.1; 285/137.2

[58] Field of Search ..... 166/75.1, 97.1, 368, 166/339, 344, 313; 285/137 A, 137 R, 137.1, 137.2

[56] References Cited

U.S. PATENT DOCUMENTS

| | | | |
|---|---|---|---|
| 3,097,695 | 7/1963 | Le Rouax et al. | 166/97.5 |
| 3,451,481 | 6/1969 | Lanmon, II | 285/137 A X |
| 3,834,460 | 9/1974 | Brun et al. | 166/344 X |
| 4,154,302 | 5/1979 | Cugini | 166/97.5 X |

FOREIGN PATENT DOCUMENTS

| | | | |
|---|---|---|---|
| 2048992 | 12/1980 | United Kingdom | 166/344 |

*Primary Examiner*—Stephen J. Novosad
*Assistant Examiner*—David J. Bagnell

[57] ABSTRACT

A tubing hanger for landing is a subsea wellhead system below a multiple bore valve package in a preferred but not essential orientation with a first concentric and a second eccentric bore both suitable for vertical access for passage of tools and the such like when in the preferred orientation, the first bore being contained within a first concentric seal and the second bore being contained within an annular area outside the first concentric seal and within a second larger concentric seal such than when the tubing hanger is not landed in the preferred orientation vertical access is not provided but the valve package can be landed and hydraulic communication will be provided through both bores.

6 Claims, 4 Drawing Figures

SUBSEA TUBING HANGER WITH MULTIPLE VERTICAL BORES AND CONCENTRIC SEALS

Oil and gas wells drilled on the ocean floor characteristically have a central housing from which several concentric strings of casing are suspended. As each string of casing is landed in the housing and is cemented in place a hole is drilled through it to a deeper depth for another smaller and longer string of casing. After the hole is progressively deepened to the desired depth for production of hydrocarbons, one or more parallel strings of tubing are suspended in the well to be the actual flowpaths for the production of the hydrocarbons. Characteristically, the casing strings are cemented into the well and the tubing strings are retrievably landed within the well. A blowout preventer stack is landed on the housing during the drilling, cementing, and tubing running operations. The blowout preventers are valves specially designed to provide pressure protection for the well during these operations. After the tubing is landed within the housing with a tubing hanger and plugs are set in the tubing bores, the blowout preventer stack is removed and replaced with a christmas tree. The christmas tree is an assembly of valves and other components to allow the production of the hydrocarbons from the well into subsea pipelines.

Subsea wells typically involve one or more strings of tubing plus an access into the annulus outside the tubing strings and within the first string of casing, typically called the oil string. The most common combination is that of having a single string of tubing plus the annulus access, and that is the area where the present invention is directed.

Conventionally the requirement for access to two areas within the bore of the housing requires that the tubing hanger be oriented and separate stab subs from the christmas tree stab into and sealingly engage ports in the tubing hanger.

A problem has been encountered in subsea wells when the tubing hangers are landed in an orientation other than the proper orientation. The stab subs are prevented from engaging the ports in the tubing hanger and instead strike the flat upper surface on the tubing hanger. This causes the tubing hanger to stop higher than the required position for sealing and connection and therefore the connection cannot be made. The situation is further complicated by the difficulty in determining that the tubing hanger is misoriented in the deep ocean waters and by the expense of the time delays.

One attempt to resolve this difficulty has been to provide a bore for a single string of tubing concentric to the tubing hanger plus a pair of relatively large concentric seals on a male sleeve mounted on the christmas tree. A female receptacle is provided on the tubing hanger and horizontal ports are provided on each member for annulus communication. This is similar to the method of providing for control lines to down hole safety valves, as is also shown on the drawing of the present invention.

This method does allow the non-oriented access into a tubing string plus the annulus access, but completely abandons the possibility of putting a retrievable plug into the annulus access to secure the well when neither the blowout preventer stack nor the christmas tree is in place. During these times the well must then be controlled by permanently installed check valves or by filling the well with heavy mud. Neither of these are a desireable solution.

SUMMARY OF THE INVENTION

The object of the present invention is to provide a multiple bore tubing hanger which provides vertical access into 2 or more bores, but will still allow the landing of the christmas tree if the tubing hanger is landed out of orientation.

The invention provides a first concentric bore in the center of the tubing hanger for the tubing string closely surrounded by a tubing hanger to christmas tree seal. Outside of the seal is a eccentric satellite bore for the annulus access without an eccentric seal. A larger concentric seal is provided between the tubing hanger and the christmas tree at a radial distance greater than the outermost dimension of the satellite bore. In this construction, all seals are concentric, but all bores are vertical.

When the tubing hanger and the christmas tree are properly landed, communication is allowed and straight vertical access is allowed thru the christmas tree down to the tubing hanger to install plugs in both bores. If the tubing hanger is not properly oriented, the christmas tree can still be landed and communication is established. Vertical access to the central bore is allowed but vertical access to the satellite bore is not available.

In like manner a second satellite bore and a third concentric seal ring can be provided to allow two tubing strings plus an annulus access.

BRIEF DESCRIPTION OF THE DRAWINGS

FIG. no. 1 is a sectional view of a wellhead with the tubing hanger of the invention with the connection section of the christmas tree shown landed on the top of the housing.

FIG. no. 2 is a partial section of the seal area between the connector section and the tubing hanger on the left side of the centerline showing expanded detail of the seals.

FIG. no. 3 shows the tubing hanger and seals of this invention in a subsea completion system on an oil or gas well.

FIG. no. 4 shows a cross section thru the upper portion of the tubing hanger along lines 4—4 of FIG. no. 1.

DESCRIPTION OF THE PREFERRED EMBODIMENT

Figure 1:
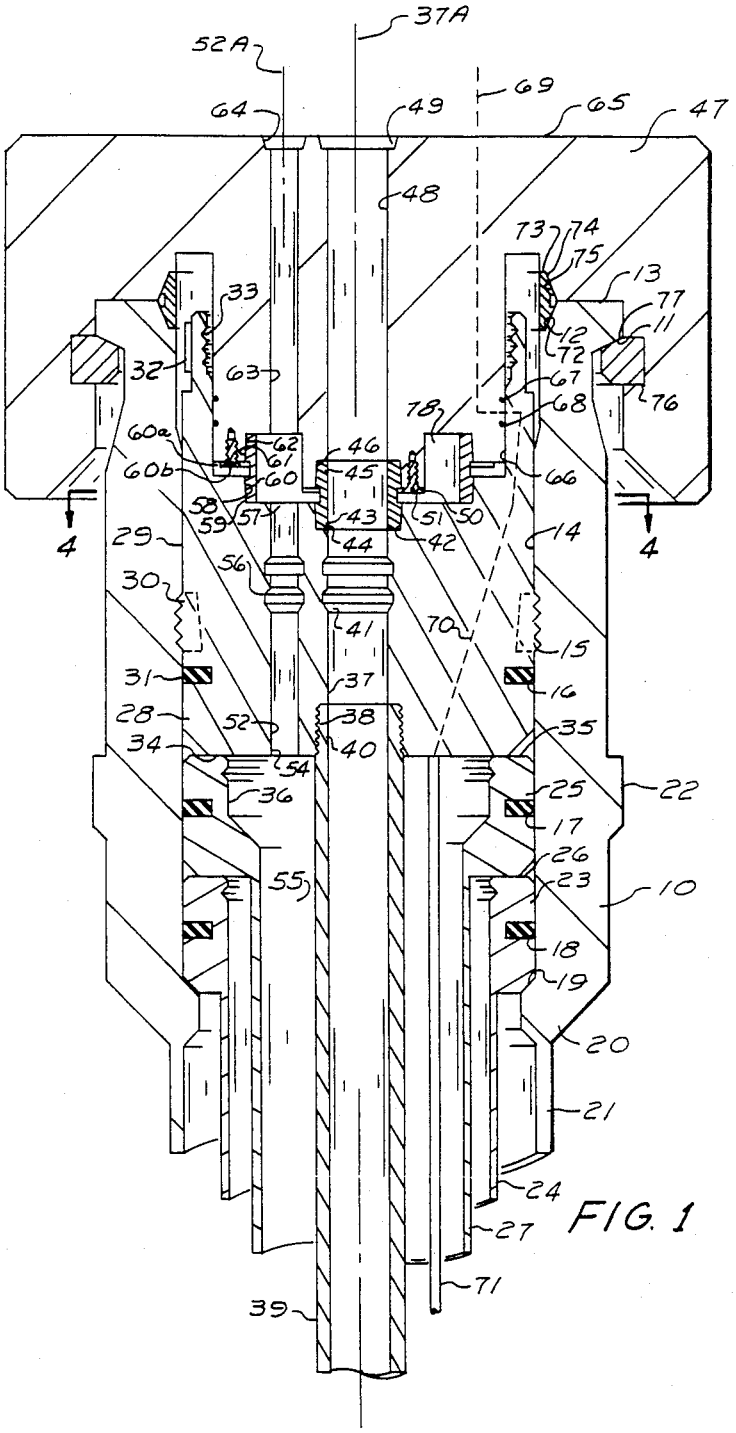
Figure 2:
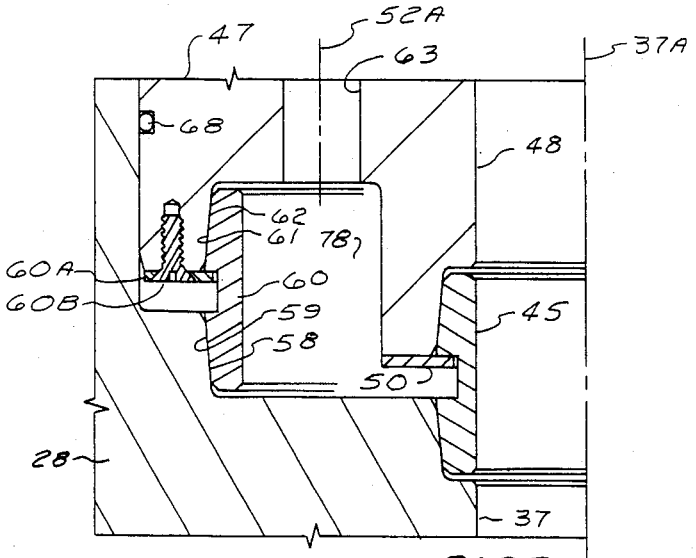
Figure 4:
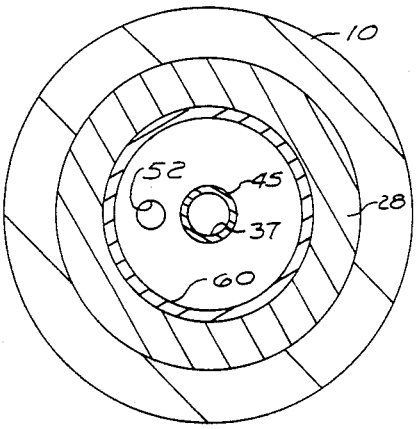
Figure 3:
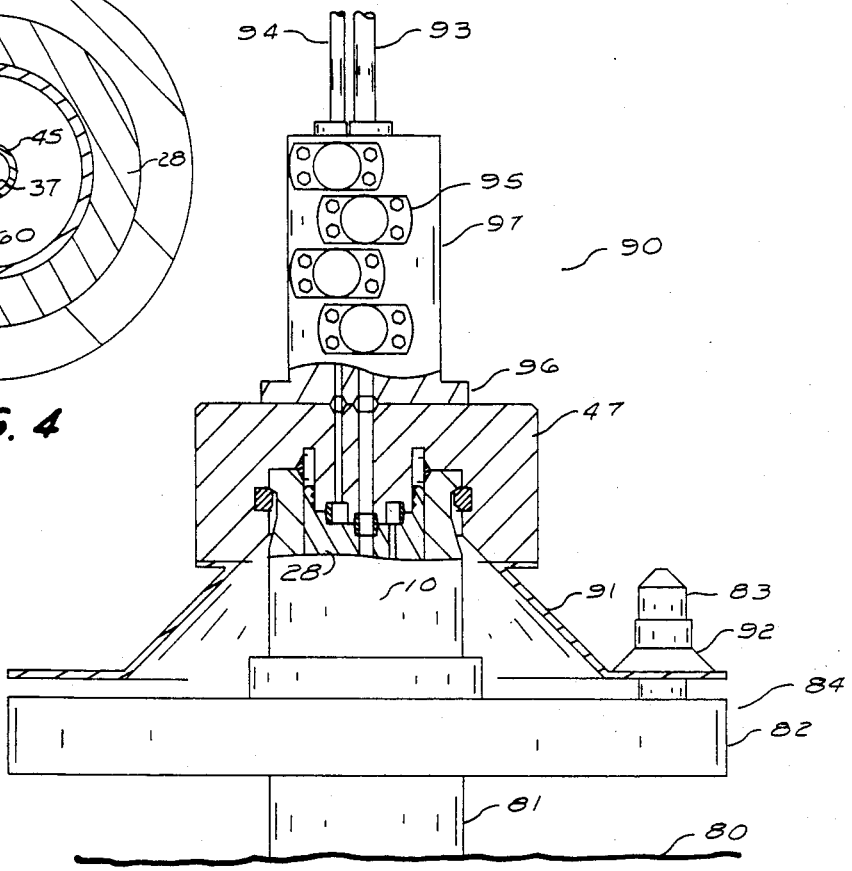

As shown in FIG. 1, a housing 10 provides a locking shoulder 11 and a seal surface 12 near the upper end 13. An internal bore 14 provides lockdown grooves 15; seal areas 16, 17, and 18; and a lower shoulder 19. The lower end 20 connects to a first string of casing 21. An outer ring 22 is suitable for connecting to typical subsea guide bases.

A first casing hanger 23 lands on shoulder 19, suspends casing string 24, and seals against the housing bore 18. A second casing hanger 25 lands on upper shoulder 26 on the first casing hanger 23, supports casing string 27 and seals against the housing bore 17.

The tubing hanger 28 has an external profile 29 including lockdown dogs 30 which engage housing grooves 15, seal means 31 which seals against the housing at 16, and an orientation key 32 which is used in conjunction with a tubing hanger running tool (not shown) to provide landed orientation to the tubing hanger. See Pat. No. 4,067,062 for additional details on this type equipment. Profile 33 near the top of the tubing hanger 28 is engaged by the running tool (not shown) to lower the tubing hanger from the drilling rig at the water's surface above to the housing. The lower shoulder 34 on the tubing hanger 28 lands on the upper shoulder 35 of the casing hanger 25. Inner profile 36 of casing hanger 25 can provide an alternate landing and sealing location for a tubing hanger such as 28 when the relative size requirement for the tubing hanger is small in comparison with the size of the housing.

The tubing hanger 28 has a central concentric bore 37 about centerline 37*a* which terminates at its lower end with a threaded preparation 38 which in turn supports tubing string 39 by its threaded section 40. The centerline 37*a* is the common centerline for the bore 37, the tubing hanger 28, the housing 10, and the tree connector section 47. About midway up bore 37 is a landing nipple profile 41 which is suitable for receiving a remotely installed locking mandrel with plug (not shown) See Otis Engineering Catalog, page 5972 to 5975 in the 1980–1981 Composite Catalog of Oil Field Equipment and Services for additional information on this equipment.

At the upper end of bore 37 is a seal preparation 42 which is sealingly engaged by seal ring 43 at its lower end 44. Upper end 45 of seal ring 43 sealingly engages seal preparation 46 on the tree connector section 47.

Bore 48 in tree connector section 47 is concentric with bore 37 and terminates at its upper end with seal preparation 49.

The tree connector section 47 is generally shown to be a composite of a connector assembly and a section which seals with the tubing hanger and extends up to a level suitable for installation of the christmas tree valves. See U.S. Pat. No. 3,321,217 for further details on a connector of this type.

Plate 50 with bolts 51 retains seal ring 43 on the lower end of the tree connector section 47 during running and retrieval of the tree connector section 47.

Bore 52 about centerline 52*a* is eccentric to the centerline 37*a* of the well bore and radially spaced outward from the outer diameter 53 of the seal ring 43. The lower end 54 of bore 52 has no threaded preparation to support a string of tubing, but rather opens directly into the annular area 55 outside tubing string 39 and within the casing string 27 providing what is referred to an "annulus access".

About midway up the bore 52 is a landing nipple profile 56 which is similar to the landing nipple profile 41. The upper end 57 of bore 52 does not include a bore seal preparation which is concentric to the bore 52.

Seal preparation 58 is concentric to the centerline 37*a* of the tubing hanger 28 and is sealingly engaged by surface 59 of seal ring 60. Surface 61 on seal ring 60 seals against surface 62 on tree connector section 47. Plate 60*a* and screws 60*b* retain seal ring 60 to the tree section during the running and retrieving operations. A bore 63 is provided in the tree connector section 47 to be approximately concentric with bore 52 in the tubing hanger 28 and terminates at its upper end with seal preparation 64. Seal preparations 49 and 64 are engaged by seals for christmas tree valves (not shown) mounted on the top 65 of tree connector section 47.

Bore 66 is provided in the tubing hanger 28 for sealing by seals 67 and 68 which are mounted in the tree connector section 47. Port 69 in the tree connector section 47 connects with port 70 in tubing hanger 28 and control line 71 to provide a control signal path to operate a subsurface safety valve. Valves of this type are common within the industry and are illustrated on page 5981 of the Otis Section within the 1980–1981 Compsite Catalog of Oilfield Equipment and Services.

Surface 72 on seal ring 73 seals against surface 12 on housing 10 and surface 74 seals against surface 75 on tree connector section 47.

Retractable dog means 76 provide a surface 77 to load and lock against surface 11 on housing 10. See co-pending application Ser. No. 06/343,496 for additional information on this type of subsea housing connector.

As can be seen with seal ring 43 and 60 sealing against tubing hanger 28 and tree connector section 47, pressure coming from annulus area 55 up thru bore 52 will pass into an annular cavity 78 within seal ring 60 and then up thru bore 63. If the relative orientation of the tree connector section 47 and the tubing hanger 28 is as shown, the capability of vertical access thru bore 63 into bore 52 is available for operations such as setting plugs into the profile 56. If proper orientation is not established for any reason, the tree connector section will still land on the tubing hanger 28 and communication will be provided thru annular area 78, however, vertical access into the bore 52 will not be possible. The center concentric bores 37 and 48 will provide vertical access and communication irrespective of the orientation to the tubing hanger 28 to the tree connector section 47. Similarly, the control line ports 69 and 70 will be communicated together irrespective of the orientation, and are not intended for vertical access at any time.

The tubing hanger 28 and tree connector section 47 of this invention retains all of the positive desired characteristics of other multiple bore tubing hangers and adds the capability of handling the situation when the tubing hanger is accidentally (or intentionally) landed out of orientation.

FIG. no. 2 shows the seal rings 45 and 60 sealing both the tubing hanger 28 and tree connector section 47. This section is taken to the left of the centerline 37*a* and shows the tree connector section 37 is the same orientation as that on FIG. no. 1. The tubing hanger 28 is shown at some other orientation than the preferred orientation of FIG. No. 1. Therefore, there is no access into the bore 52 as shown on FIG. no. 1 from the bore 63 shown on this figure and on FIG. no. 1. The sealing engagement between the seals and both the tree connector section 47 and the tubing hanger 28 such as that shown between the surfaces 61 and 62 are typically of an interference fit metal to metal contact. The interference is accomplished by having the surfaces 61 and 62 tapered and toleranced such that engagement to the position as shown will cause the the interference. The surfaces are finished to a relatively smooth 32 RMS or smoother finish to assist in the sealing characteristics. The 32 RMS surface finish measurement in well known in the industry.

FIG. no. 3 shows the application of the invention in an actual subsea christmas tree 90 capable of producing oil or gas which is landed on a guide base and housing system 84. The tubing hanger 28 is within the housing 10 and below the tree connector section 47 as in FIG. no. 1. The ocean floor or mudline is shown at 80 with a surface casing string 81 extending into the ocean floor as the largest and first casing string. The guide base 82 and the short orientation post 83 are landed with the surface casing string 81. The housing 10 and the other casing and tubing strings are landed within the surface casing string 81 during subsequent operations. A large concentric funnel 91 with its small eccentric orientation funnel 92 are connected to the bottom of the wellhead connector section 47.

Valve assembly 97 is connected to the top of the tree connector section 47 by an appropriate flange type connection 96 and includes valves 95 to seal off each of the vertical bores. Tubing production risers 93 and 94 take the production from this subsea completion system directly to the surface of the ocean to a floating production system for storage, processing, and transportation to shore.

When this subsea christmas tree 90 is lowered to the ocean floor on the tubing production risers 93 and 94, it is approximately oriented with respect to the guide base and housing system 84 and landed as shown. The short orientation post 83 insures that the subsea christmas tree 90 will be landed in the proper orientation. Similar orientation was done for the drilling equipment previously landed which in turn would have provided means to orient the tubing hanger 28. The orientation between the drilling means and the tubing hangers has historically been unreliable.

The tubing hanger 28 of this figure is shown landed 180 degrees out of orientation to illustrate the fact that the concentric seals 45 and 60 allow the subsea christmas tree 90 to be landed and the completion made irrespective of the orientation of the tubing hanger 28. Essential hydraulic circulation for production operations is accomplished from the bore 63 of the tree connector section 47 to bore 52 of the tubing hanger 28 by the path of the annular cavity 78 (see FIG. no. 1).
In this case with the tubing hanger 28 not in the proper orientation with respect to the other parts of the system, the ability to pass a plug down from the bore 63 in the tree connector section 47 to the bore 52 in the tubing hanger 28 is lost.

FIG. no. 4 gives a section thru the top of the tubing hanger along lines 4—4 of FIG. no. 1. It shows that the seals 45 and 60 are concentric with the centerline of the bore 37 of the tubing string 39, the tubing hanger 28, and the wellhead housing 10. This shows that irrespective of the relative rotation of any of these parts, an effective seal can be accomplished between the tubing hanger 28 and the tree connector section 47. Bore 52 of the tubing hanger 28 is shown in an eccentric, satellite position to the centerline of the various parts and between the seals 45 and 60. Bore 37 is sealingly contained within seal no. 45. Bore 52 is sealingly contained within the seals 45 and 60.

The foregoing disclosure and description of the invention are illustrative and explanatory thereof, and various changes in the size, shape and materials, as well as the details of the illustrated construction may be made without departing from the spirit of the invention.

I claim:

1. A tubing hanger for oil and gas wells suitable for landing and sealing in a wellhead system and below a multiple bore valve block providing the ability for direct vertical access thru the multiple bore valve block into two or more bores in the tubing hanger when in a preferred orientation relationship with the multiple bore valve block combined with the ability to assemble the multiple bore valve block over the tubing hanger even when the tubing hanger is landed in other than the preferred orientation relationship, said tubing hanger having a preferred but not essential orientation, a first bore which is concentric with the centerline of the tubing hanger and is suitable for vertical access for the passage of tools and the such like thru a first bore of said valve block, a first seal means about said first bore, a second vertical bore which is eccentric to said centerline of said tubing hanger and outside of said first seal means and which is suitable for vertical access for the passage of tools and the like, a second seal means which is concentric with the centerline of said tubing hanger and is spaced radially outwardly from said second bore, said first bore being sealingly contained within said first seal means, and said second bore being sealingly contained in the annular area outside said first seal means and inside said second seal means.

2. The invention of claim 1 wherein said first and second seal means are seal rings which sealingly engage said tubing hanger on their lower ends and engage and extension from said valve block on their upper ends.

3. The invention of claim 2 wherein said first seal ring provides metal to metal sealing contact between said seal ring and said tubing hanger and metal to metal sealing contact between said first seal ring and said extension from said valve block.

4. The invention of claim 3 wherein said second seal ring provides metal to metal sealing contact between said second seal ring and said extension from said valve block.

5. The invention of claim 1 wherein said first and said second seal means provide metal to metal seal means between the lower end of said seal means and said tubing hanger.

6. Then invention of claim 1 including at least one additional port fluidly communicating between said extension section from said valve block and said tubing hanger for control of functions below the tubing hanger within the well, said additional port not providing vertical access for the passage of tools and the such like at any orientation.

* * * * *